US005396234A

United States Patent [19]

Gebert et al.

[11] Patent Number: 5,396,234

[45] Date of Patent: Mar. 7, 1995

[54] VALIDATION CHECKING IN TRAFFIC MONITORING EQUIPMENT

[76] Inventors: Franz J. Gebert; Rudiger H. Gebert; Ralf D. H. Gebert, all of Unter Den Ulmen 16, 4100 Duisburg 12, Germany

[21] Appl. No.: 168,977

[22] Filed: Dec. 16, 1993

Related U.S. Application Data

[63] Continuation of Ser. No. 796,004, Nov. 22, 1991, abandoned, which is a continuation-in-part of Ser. No. 491,261, Mar. 9, 1990, abandoned.

[30] Foreign Application Priority Data

Mar. 10, 1989 [ZA] South Africa ..... 89/01830

[51] Int. Cl.[6] ..... G08G 1/01

[52] U.S. Cl. ..... 340/936; 340/933; 340/939; 340/941; 340/937; 377/28

[58] Field of Search ..... 340/936-939, 340/933, 941; 364/438, 440; 377/9, 28; 371/2.1, 6, 14, 29.5, 17, 18; 235/95 R, 95 A

[56] References Cited

U.S. PATENT DOCUMENTS 3,406,395 10/1968 Zupanick ..... 340/936
3,506,809 4/1970 Pallat .
3,571,789 3/1971 Midlock ..... 340/941
3,634,843 1/1972 Corris ..... 340/941
3,701,102 10/1972 Berman et al. ..... 340/933
3,745,450 7/1973 Wilt ..... 340/941
3,863,206 1/1975 Rabie ..... 340/939
3,943,339 3/1976 Koerner et al. ..... 340/939
4,214,265 7/1980 Olesen ..... 340/937
4,368,428 1/1983 Dijkman ..... 340/936
4,568,937 2/1986 Clark ..... 340/941
4,668,951 5/1987 Duley et al. ..... 340/941
4,680,717 7/1987 Martin ..... 340/941
4,866,438 9/1989 Knisch ..... 340/936

*Primary Examiner*—Donnie L. Crosland
*Attorney, Agent, or Firm*—Ladas & Parry

[57] ABSTRACT

Traffic monitoring equipment including traffic speed measuring equipment has a signal validation facility incorporated to enhance reliability of the equipment. This facility permits the monitoring operation, for example speed measurement, to proceed only if the validation is positive, if negative the operation is aborted and/or a warning signal or shutdown is activated. Validation is made of pulse sequence, pulse strength, radio frequency interference, insulation breakdown, cable integrity (where cables are used) and the like.

9 Claims, 8 Drawing Sheets

VALIDATION CHECKING IN TRAFFIC MONITORING EQUIPMENT

This is an application of Ser. No. 07/796,004, filed on Nov. 22, 1991, now abandoned, which is a continuation-in-part of application Ser. No. 07/491,261, filed Mar. 9, 1990, now abandoned.

BACKGROUND

1. Field of the Invention

This invention relates to automatic validation checks applied to traffic monitoring equipment including traffic speed detection equipment. The invention is, however, in principle applicable to any traffic data collection equipment subject to what will be said herein below. An area of primary application which is envisaged, for-example, is traffic monitoring equipment based on a cable, cables and/or detector pads, magnetic loop detectors or others such as optical systems or pneumatic tube systems extending across a road or other surface and providing electrical signals for timing/counting purposes.

As is known such electrical signals can have one or more of several physical origins including piezo-electric effects either resistive and/or generative piezo-electric effects, capacitive effects and tribo-electric effects, for example. These signals are used to start and stop time measurements in order to calculate for example vehicle speed, axle distance, tyre contact length etc., and count or weigh axles of vehicles passing over these sensors. The validation checks or security checks are to be provided to enhance the reliability, accuracy and convenience of operating such equipment. This can have favourable legal implications when the equipment is used for law enforcement. Generally less reliance is therefore placed on the operator of the equipment to ensure the integrity of the equipment and the security of the measurements it takes.

2. Prior Art

In the application of the existing art a number of sources of error could exist which have as yet not been satisfactorily dealt with. As a result the existing equipment is subject to possible error from these causes. These include cable swopping errors (including incorrect sequence of signals), insufficient signal amplitudes, radio frequency interference or electromagnetic interference with the signals, spurious signals or signals of non-standard timing originating from damaged cables.

Thus there is a problem of improvement of measuring, for example, the speed of vehicles, on the basis that speed equals distance divided by time more, accurately and reliably by this invention. The improvement of accuracy lies within checking one or a combination of the factors which will be discussed below.

SUMMARY OF THE INVENTION

One object of the present invention is to check the correct sequence of impulses derived from several cables, a single cable and/or a sensor pad or other sensor according to the set up of the equipment. This can be a security against, for example, swopping errors, incorrect connection of cable to the equipment after the cables have been set out in a suitable array on a road surface, for example in the case of a duplicated pair of cables extended across the full width of a road in a spaced parallel array for speed law enforcement.

Here the correct sequence of pulses, for an array ABCD in that order on the road, will be cable A, then cable B followed by cable C and then cable D or, the reverse sequence for traffic in the opposite direction on the other side of the road being, cable D then cable C, then cable B and then cable A.

In this way the speed checking is done by independent time measuring devices, i.e. instrument L function measures the time from cable A to cable C independently of the instrument 2 which measures from cable B to cable D, each on either the front or the back axles or any other axles in physical contact with the road. This verification can also have, for example, application in measurement of deceleration and acceleration and vehicle travel direction.

Any pulse sequence other than these will be rejected for data processing purposes by the instrument as a result of this validity checking facility. An incorrect sequence of pulses can also be caused by defective or damaged cables or improperly installed cables resulting in "missing" or "additional" pulses being detected in a sequence of pulses, e.g. A C D or A B B C D. This abnormal sequence will be rejected as mentioned before. A single or spurious signal occurring will be rejected if the rest of the sequence has not been validated within a certain time. The above sequences were used as an example only. Other arrays (e.g. consisting of three cables) or other sequences or automatic sequence detection may also be implemented.

Automatic sequence detection from an arbitrary array of cables can be implemented by monitoring and comparing the sequence of pulses of a number of vehicles after the instrument was switched on. This sequence is then memorised as being correct and any sequence of pulses other than this memorised sequence will be rejected as described above.

If pulse sequences errors recur regularly/repeatedly an error message could be displayed.

This sequence checking verification can be generalised as stated to any desired or required arrays of cable, cables and/or detector pads, magnetic loop detectors or others such as optical systems or pneumatic tube systems.

A further object of the invention is to provide a facility for signal strength monitoring. Thus each individual pulse, be it piezo-electric or tribo-electric or both in origin of either positive or negative polarity, i.e. either a signal which first rises (positive) from zero to a peak, then oscillates about zero with decaying amplitude, OR a signal which first falls (negative) from zero to a negative peak, then oscillates about zero with decaying amplitude; must pass through a minimal signal trigger level i.e. a setpoint above zero (for a positive signal) above which the signal must rise, or a setpoint below zero (for a negative signal) below which the signal must fall, before being detected as a valid trigger (or start (or stop) point) for time measurements. The reference level of zero is given only as an example and other offsets may be used.

Once a valid pulse has been detected and the signal keeps on rising (or falling) and exceeds a second threshold greater in absolute value than the minimal signal level, a further signal strength validation signal. may be generated. This validation signal must occur Within a certain maximum time from the valid pulse for the pulse to be accepted as a trigger for data processing purposes.

Should these conditions not be met the whole sequence of pulses will be ignored for data processing purposes. Should this error condition recur regularly an error message could be displayed.

An Electromagnetic Interference (EMI) check can be performed. EMI radiated through the air or conducted along wires, from sources such as, for example, two-way radios, high frequency communication, high tension cables or lightning, noise generated from switching/controlling circuits, e.g. thyristors, DC motors, etc., can be monitored by the instrument to ensure that no EMI interference is present during and in between measurements. To the extent thus that the external cables act as antennas for electromagnetic energy fields and any risk of this causing measurement errors can be excluded.

Any EMI detected during a measurement sequence will result in that measurement sequence to be rejected for data processing purposes. recurs If this error condition frequently an error message could also be displayed.

The EMI detector circuit can be driven from conventional antennas (e.g. vertical, ferrite rod etc.) or from transformer coupling to external cables.

Capacitance checking for possible degradation of the inner co-axial conductor or the cable screen in the case of a co-axial conductor can be a method of checking for damaged or sub-standard cables. Here the instrument will be designed to monitor, for example, frequency changes, phase changes, changes in natural frequency, ringing of the cable and any other means of detecting changes in capacitance.

For example, any particular cable will be detected to have a certain capacitance per metre length and should a break occur of course the capacitance will change and an error signal can be produced indicating a faulty cable. The instrument can also be placed in a waiting mode where further data processing is inhibited until the operator replaces the faulty cable. Thus the integrity of the inner core conductor and/or of the coaxial screen conductor can be monitored automatically to provide more reliable operation for identifying worn-/damaged cables.

The monitoring of cables as described can be adapted to coaxial cables, triaxial cables, screened pair cables or any other cable construction or array.

The coaxial cables referred to herein have been referred to merely by way of example.

BRIEF DESCRIPTION OF THE DRAWINGS

The invention will be more fully described by way of examples with reference to the accompanying drawings, in which:

FIG. 6(B) graphs the function of the circuit shown in FIG. 6(A).

FIG. 8 is a circuit diagram for implementing capacitive testing,

DESCRIPTION OF THE PREFERRED EMBODIMENTS

Figure 1:
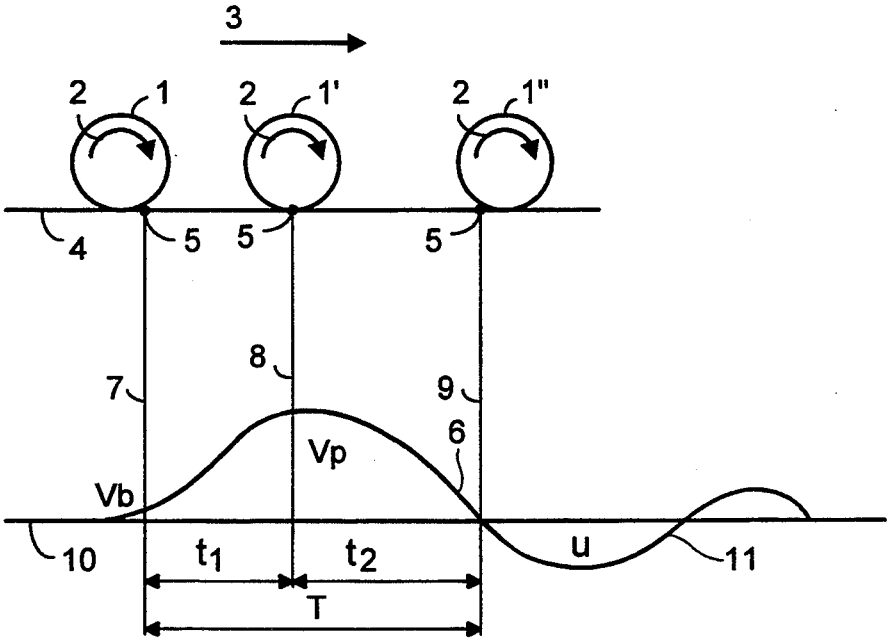
FIG. 1 is a series of schematic side views of the same vehicle wheel passing over a single cable and is an indication of the pulse generated in the cable at the various positions of the wheel shown.

As shown in FIG. 1 a vehicle wheel 1 is rotating as shown by the arrow 2 and moving forward as shown by the arrow 3 over a road surface 4 which has laid on it a cable 5 of piezo-electric shielded cable type. The wheel 1 moves to the position fully over the cable as shown at 1′ and then to the position where it is just leaving the cable as shown at 1″.

Graph 6 shows the voltage pulse produced in the piezo-electric cable 5 by the passage of the wheel and the three positions shown above the broken line 7, 8 and 9 indicating correlation between the successive positions on the graph 6 and the successive positions of the wheel 1. Thus at the position 1 of the wheel where it first touches the cable 5 is indicated by the broken line 7 the pulse begins to rise from the zero line 10 at "$V_b$".

The pulse reaches the peak at the position of the wheel 1′ as indicated by the broken line 8 at "$V_p$". The pulse then declines to a voltage of zero at the position of the wheel 1″ indicated by the broken line 9 where the pulse crosses the zero line 10 and then moves into a negative pulse portion or "under shoot U" followed by a decaying oscillation 11. Time T for the tyre footprint to first touch the cable to the moment when it leaves the cable can be regarded as composed of the two parts t1 and t2 and under normal conditions:

$$t1 = t2 \text{ and } T = t1 + t2$$

Thus for a vehicle with a tread contact are of 20 cm:

at $$100\ \text{km/h} - T100 = \frac{0{,}2 \times 3600}{100\ \text{km/h}} = 7{,}2\ \text{ms} = t1 + t2 =$$

$$t1\ 3{,}6\ \text{ms}$$

$$30\ \text{km/h} - T30 = \frac{0{,}2 \times 3600}{30\ \text{km/h}} = 24\ \text{ms}$$

$$160\ \text{km/h} - T160 = \frac{0{,}2 \times 3600}{160\ \text{km/h}} = 4{,}5\ \text{ms}$$

In normal speed timing equipment using two parallel piezo-electric cables spaced apart and set on the road in an array the time is measured between a pulse being generated in the first cable and a pulse generated in the second cable by the same set of wheels of a vehicle. On this basis speed is calculated by the formula distance divided by time or:

$$\text{speed (km/h)} = \frac{\text{(distance (in meters} \times 3600)}{\text{time (in milliseconds)}}$$

Figure 2:
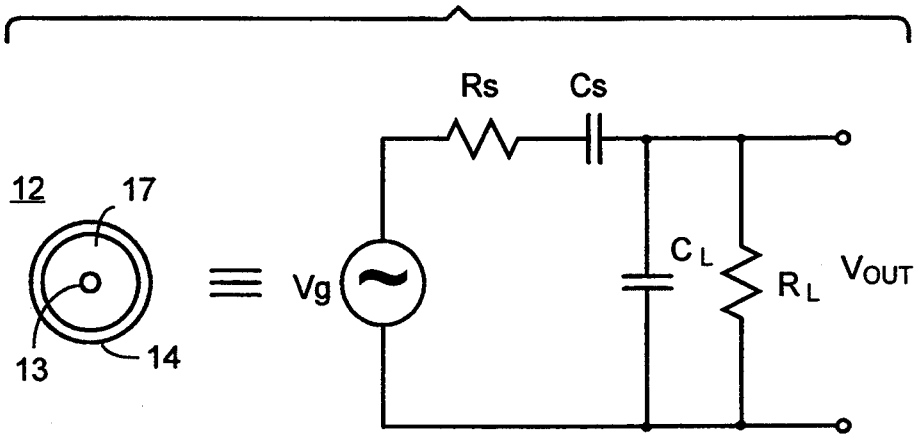
FIG. 2 is a schematic representation of an equivalent circuit for the coaxial cable.

FIG. 2(*b*) is a schematic representation of an equivalent circuit of a cable.

$V_g$=piezo-tribo electric voltage generator
Rs=series source resistance
Cs=series source resistance
RL=cable (leakage) resistance
CL=cable capacitance In FIG. 2(*a*) a concentric shielded cable 12 is shown, the central core 13 carrying the signal and the outer shield 14 being earthed. The is the equivalent circuit for the generative type of piezo-electrical and/or tribo-electrical phenomenon which is provided by the insulating material 17 between the core 13 and shield 14. (Vout)

Figure 3:
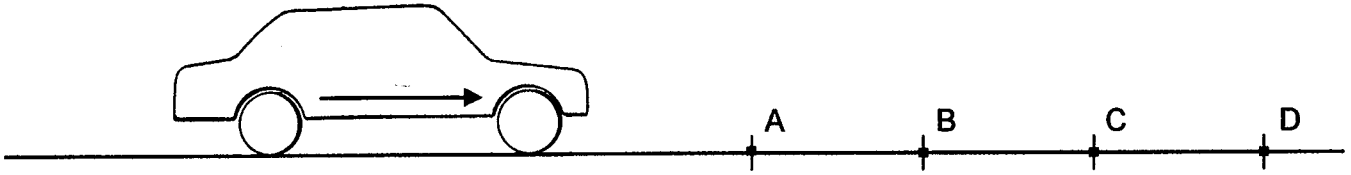
FIG. 3 is a side view of a vehicle about to pass over an array of four cables.

In FIG. 2:

Vg=piezo tribo electric voltage generator
Rs=series source resistance
Cs=series source capacitance
RL=cable (leakage) resistance
CL=cable capacitance FIG. 3 is a side view of a vehicle about to pass over an array of four cables, As shown in FIG. 3 a vehicle activating an array will activate the elements of the array in the order which they appear on the road. The vehicle in FIG. 3 will activate the elements in the order ABCD, a vehicle travelling in the opposite direction will activate the array DCBA. Thus any other sequence would be invalid and would be rejected as described. This could be implemented as shown in FIG. 4.

Figure 4:
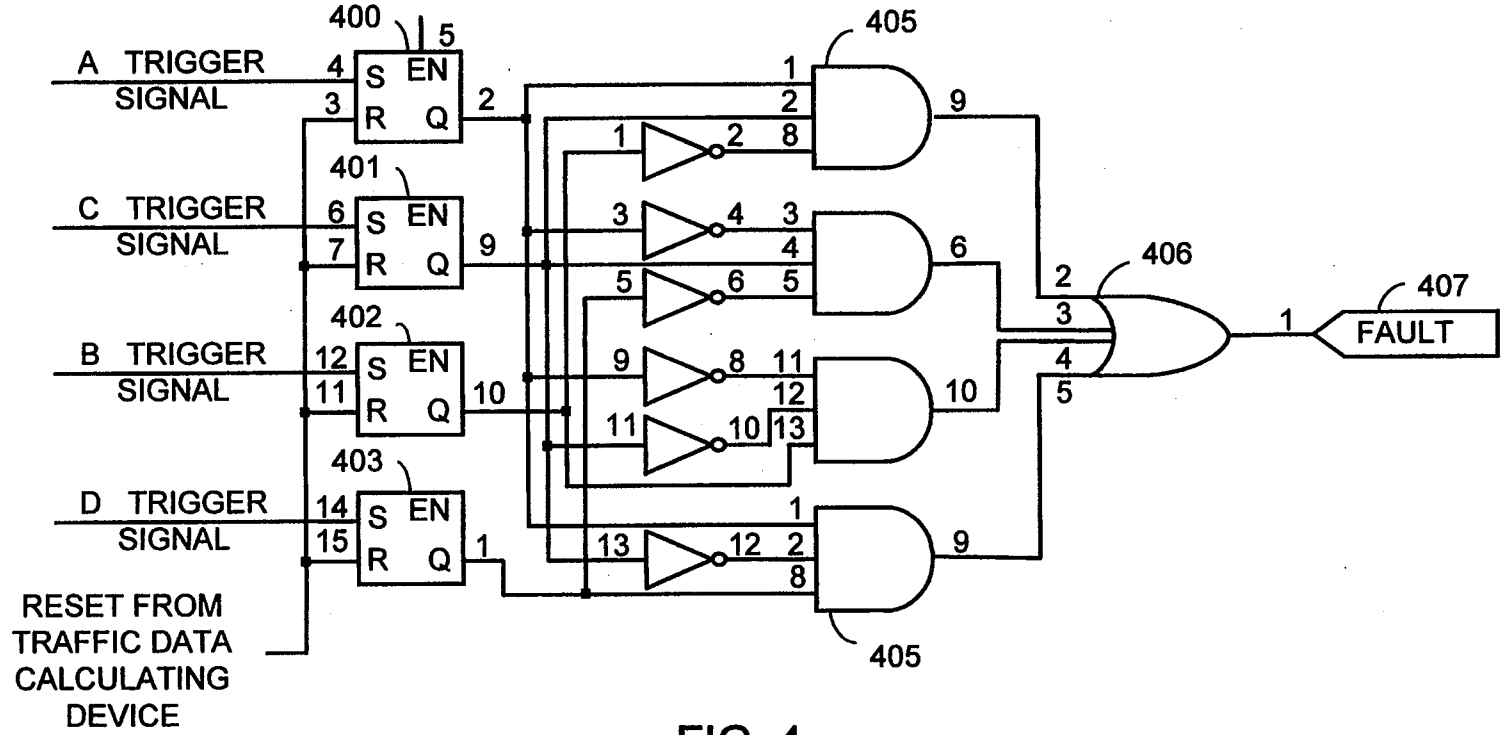
FIG. 4 is a diagram of a circuit to check for the correct sequence of signals from the cables shown in FIG. 3.

FIG. 4 is a diagram of a circuit to check for the correct sequence of signals from the cables shown in FIG. 3.

The operation of the circuit shown in FIG. 4 is described by the following table

| | 400 | 401 | 402 | 403 | Fault 407 |
|---|---|---|---|---|---|
| a | 1 | 0 | 0 | 0 | 0 |
| b | 1 | 0 | 1 | 0 | 0 |
| c | 1 | 1 | 1 | 0 | 0 |
| d | 1 | 1 | 1 | 1 | 0 |
| e | 0 | 0 | 0 | 1 | 0 |
| f | 0 | 1 | 0 | 1 | 0 |
| g | 0 | 1 | 1 | 1 | 0 |

1 = Set
0 = Reset

In FIG. 4 400 to 403 are R/S Latches and each is set by the occurrence of the trigger signal connected to it. The logic formed by inverters 404, AND gates 405 and OR gate 406 can be evaluated using standard techniques. This reveals that if a combination other than those given below occurs then a fault 407 is generated which is interpreted by the Traffic Data Calculating Device (TDCD) as described previously.

Figure 5:
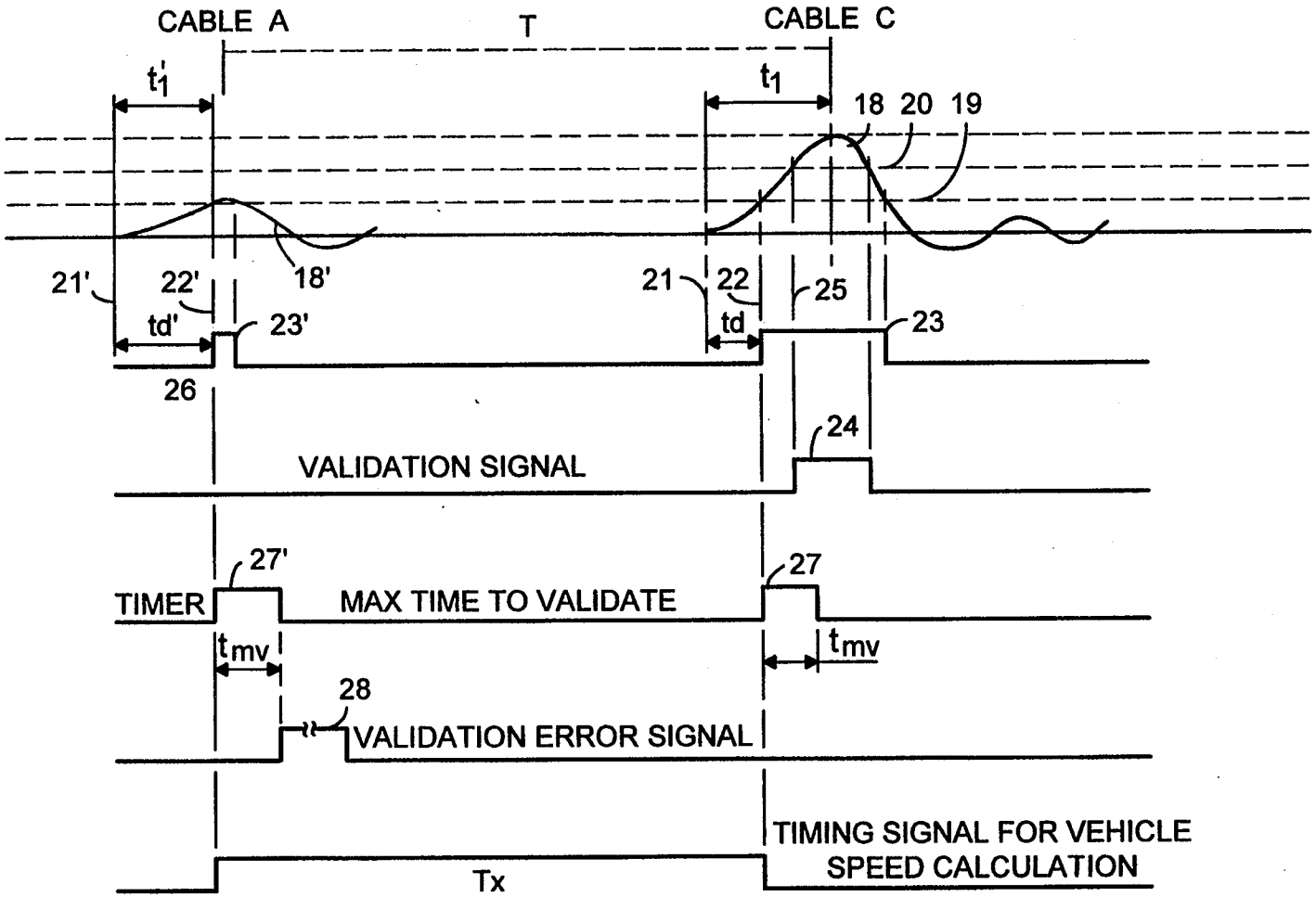
FIG. 5 is a graphical representation of respectively weak and normal signals with the resulting trigger signal shown and verification signals shown below in corresponding positions.

FIG. 5 is a graphical representation of respectively normal and weak signals with the resulting trigger signal shown and verification signals shown below in corresponding positions, in accordance with this invention.

FIG. 5 is a graphical representation of respectively normal and weak signals with the resulting trigger signal shown and verification signals shown below in corresponding positions, in accordance with this invention.

In FIG. 5 the graph 18 shows the normal pulse of the kind shown in FIG. 1 as compared with a weak signal 18'. The broken lines 19 show the trigger level and the broken lines 20 show the validation level to which the instrument is set in accordance with this invention. The broken lines 21 and 21' show the commencement of the pulse 18 and 18' respectively and the broken lines 22 and 22' the commencement of the trigger signal 23 and 23'' respectively which follows after a time delay td from the commencement of the signal.

The validation signal 24 commences at the instant indicated by the broken lines 25. Maximum time to validate signal is initiated by trigger signal 23 and 23' and continuous for a certain time period tmv. If the validation signal has not occurred by the end of the maximum time to validate signal 27 and 27' a validation error signal 28 will be generated.

The pulse sequence is rejected for measurement purposes by using the validation error signal for example:

A vehicle travelling at a speed of 100 km/h t1 (as shown in FIG. 1) =3,6 milliseconds (ms) and td t1, when a NORMAL OR GOOD SIGNAL is received. However with a weak signal td1'=t1'=3,6 ms. (FIG. 5) In view of the delay td' above we should therefore consider the above speed being measured over a distance of 1,5 m (see note below) the error occurrence if signal strength is not applied can be: If two good signals from start cable (e.g. cable A) and stop cable (e.g. cable C) with td 0 are received; to the time travelled of the front wheel of a vehicle over a measuring distance of 1,5 m at a speed of 100 kms is equal to 54 ms.

$$\text{Time} = \frac{1{,}5\text{ m} \times 3600}{100\text{ kh/h}} = 54\text{ ms} \qquad T \text{ in FIG. 5}$$

Maximum time measurement error can be 3,6 ms if start triggered at peak signal strength (delayed by 3,6 ms) (td') with the front wheel on the start cable (e.g. cable A) and stop being a good signal triggered with wheel touches the cable (cable C) (delay td=0 ms) FIG. 5.

$$\%\text{ error} = \frac{3{,}6 \times 100\%}{54\text{ ms}} = 6{,}6\%$$

NOTE The measuring distance should be less than shortest wheel base of a vehicle to avoid timing measurement being started by the back wheel on the start cable and stopped by a front wheel over the top cable.

FIG. 6 (A) is a circuit to implement the processed signals in FIG. 5.

Figure 6A:
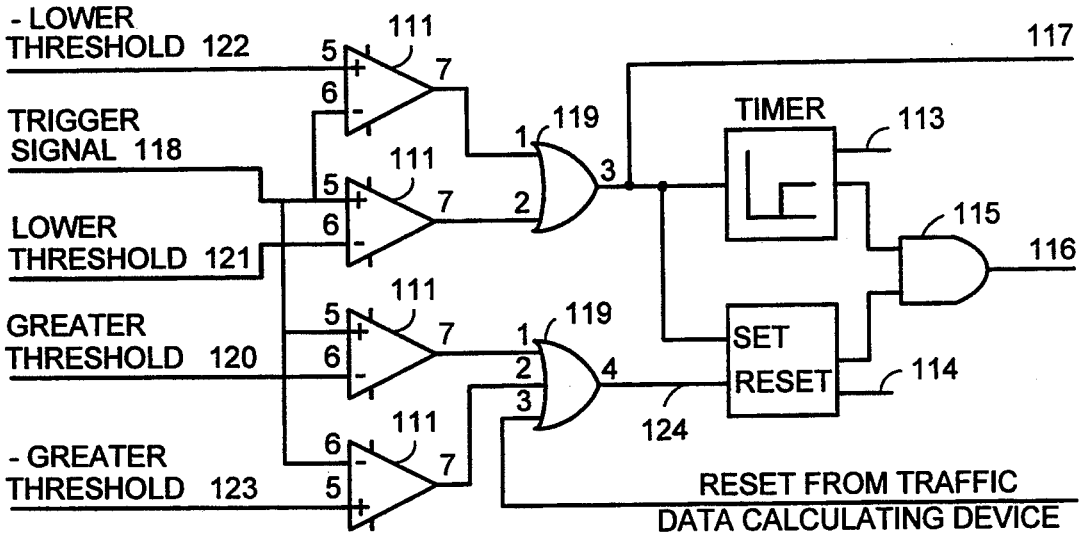
FIGS. 6A and 6B are circuits to implement the strength validating described with reference to FIG. 5.
Figure 6B:
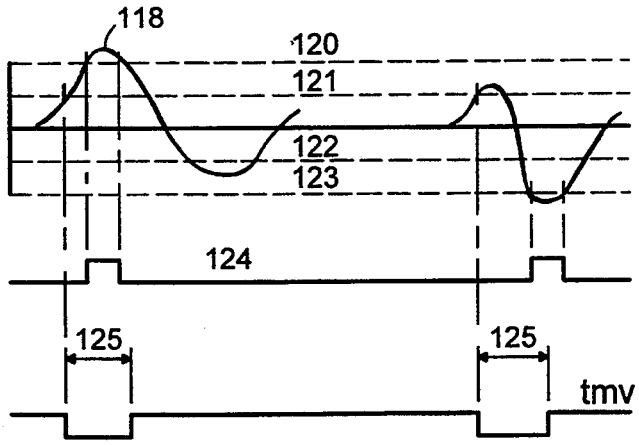

111 level comparator
113 delay circuit delay time tmv to validate output of monostable
114 latch
115 and gate
116 validation error signal
117 trigger signal to time measuring (23 of FIG. 5)
118 signal from detector cable (18 of FIG. 5)
119 or gate
120 greater threshold
121 lower threshold
122 lower threshold
123 greater threshold
124 validate signal
125 max time to validate The circuit provides a validate error signal 116 that resets the speed calculation if the signal 118 does not exceed the threshold 120, (FIGS. 6A and 6B of the drawings) within time window (FIG. 6(B) created by delay circuit 113 from the occurrence of the signal 118 exceeding the lower threshold (120 of FIGS. 6A and 6B of the drawings).

The circuit in FIG. 6(a) and graphs in FIG. 6(b) a possible implementation of a signal strength validation system. Thresholds 122, 121, 120, 123 are voltage set-points such that 121 is above the zero or reference voltage, 120 is greater than 121 (more positive) 122 is below the zero voltage and 123 is more negative than 122.

Thus if the time signal from the detector cable rises above 121 as shown in the graph the comparator 111 output will go high the OR-gate 119 output will go high and the timer 113 will be triggered and Latch 114 is set. The output of this timer will go high tmv seconds after it was triggered. If the signal 118 now either rises above 120 or falls below 123 before the output of timer 113 goes high then the latch 114 is reset and the validation error signal 116 remains low. If however, the signal does not exceed either 120 or 123 then the validation error signal goes high when the timer 113 expires (goes high).

Figure 7:
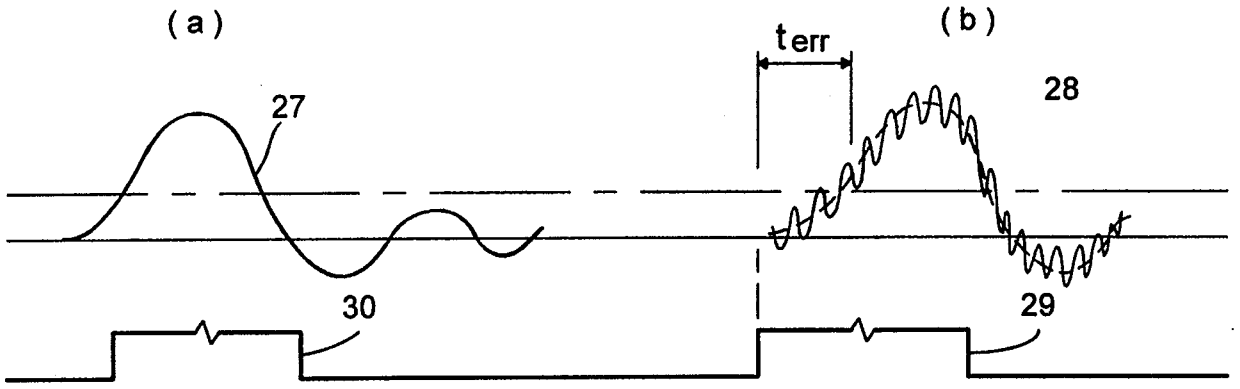
FIG. 7 is a graphical representation of respectively normal and interference plagued signals with the trigger signal shown below in relation to RFI and EMI checking.

FIG. 7 is a graphical representation of respectively normal and interference plagued signals with the trigger signal shown below in relation to RFI and EMI checking.

FIG. 7 illustrates problems resulting from radio frequency interference and electro-magnetic interference. The graph 27 shows a normal pulse and the,graph 28 a, pulse which has been degraded by RFI or EMI interference. As will be seen this interference can produce a trigger signal 29 which is premature by the amount terr as compared with the correct trigger signal as indicated at 30. This type of interference can also arise with deteriorating cables making them prone to external signals. RF and EMI signals detection components in the instrument can then provide a necessary instruction to disallow measurement when interference on these sources is detected.

Figure 8:
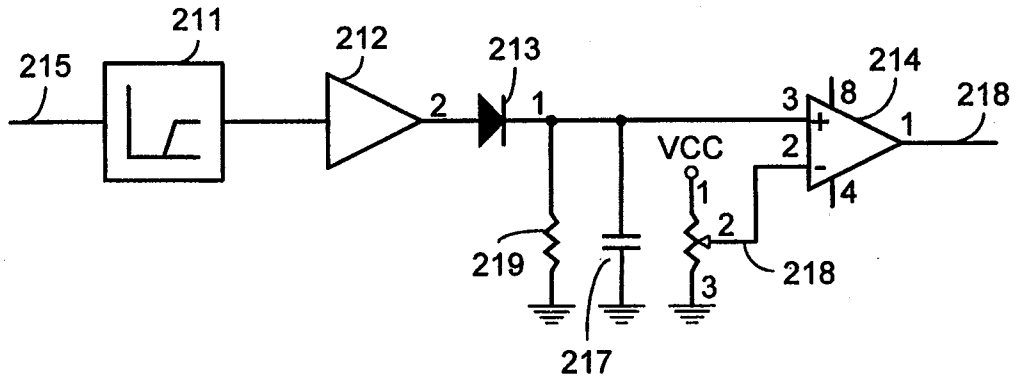
FIG. 8 is a, circuit for radio interference validating.

FIG. 8 is a circuit for Electromagnetic Interference detection.

The ambient Electromagnetic detector may be a broad band antenna feeding a broad band receiver that continuously sweeps the full RF band of concern looking for any RF signal. The antenna should be omnidirectional to be the most effective.

The same system may be used to detect Electro-magnetic Interference on wires entering the particular electronic device (such as the Traffic Data Calculating Device) but instead of an antenna a broad band coupling transformer may be used.

In FIG. 8 the input 215 is connected to an antenna or coupling transformer. If any RF signal above the cut off frequency of the filter 211 is present is amplified by 212 which is a wide band preamplifier with low noise. A high speed diode 213 rectifies the signal which charges the capacitor 217. If the charge on this capacitor exceeds the threshold 218 then the output 216 of the comparator 214 will go high and signal the presence of EMI to the microprocessor.

Figure 9:
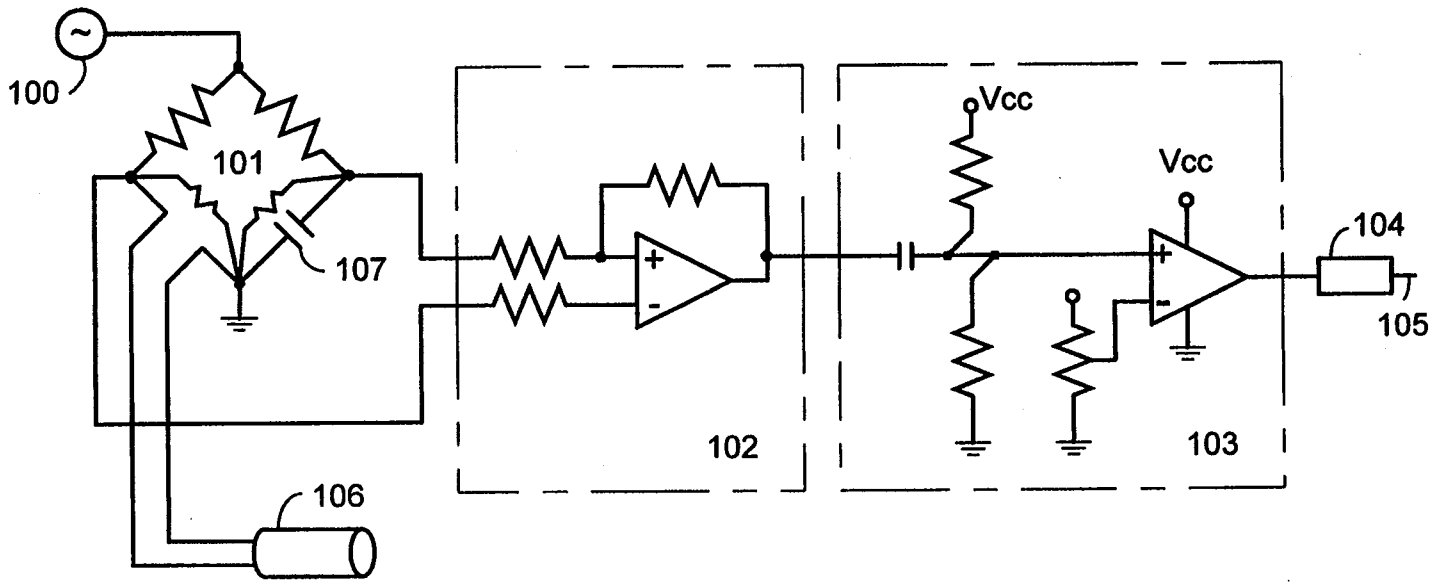
FIG. 9 is a circuit diagram for implementing capacitive testing.

FIG. 9 is an example of a circuit for measuring cable capacitance:

100. Signal from oscillation
101. Reactive Wheatstone bridge
102. Subtractor Circuit
103. Threshold comparator
104. Latch
105. Output signal becomes active if the capacitance of the cable is above or below that of the reference capacitor.
106. Cable capacitance to be measured
107. Reference capacitor;

The particular circuit is designed for cables of known fixed capacitance. The reactive wheatsone bridge is balanced by the cable capacitance 106 and capacitor 107. If the cable capacitance should change then the imbalance will be detected by subtractor circuit 102. If the amplitude of the error signal should exceed a preset threshold then circuit will give a pulse to Latch 104 which will signal the Traffic Data Calculating Device (TDCD) to stop operating or reset until the cable has been replaced. THE TDCD may then reset the Latch 104.

Figure 10A:
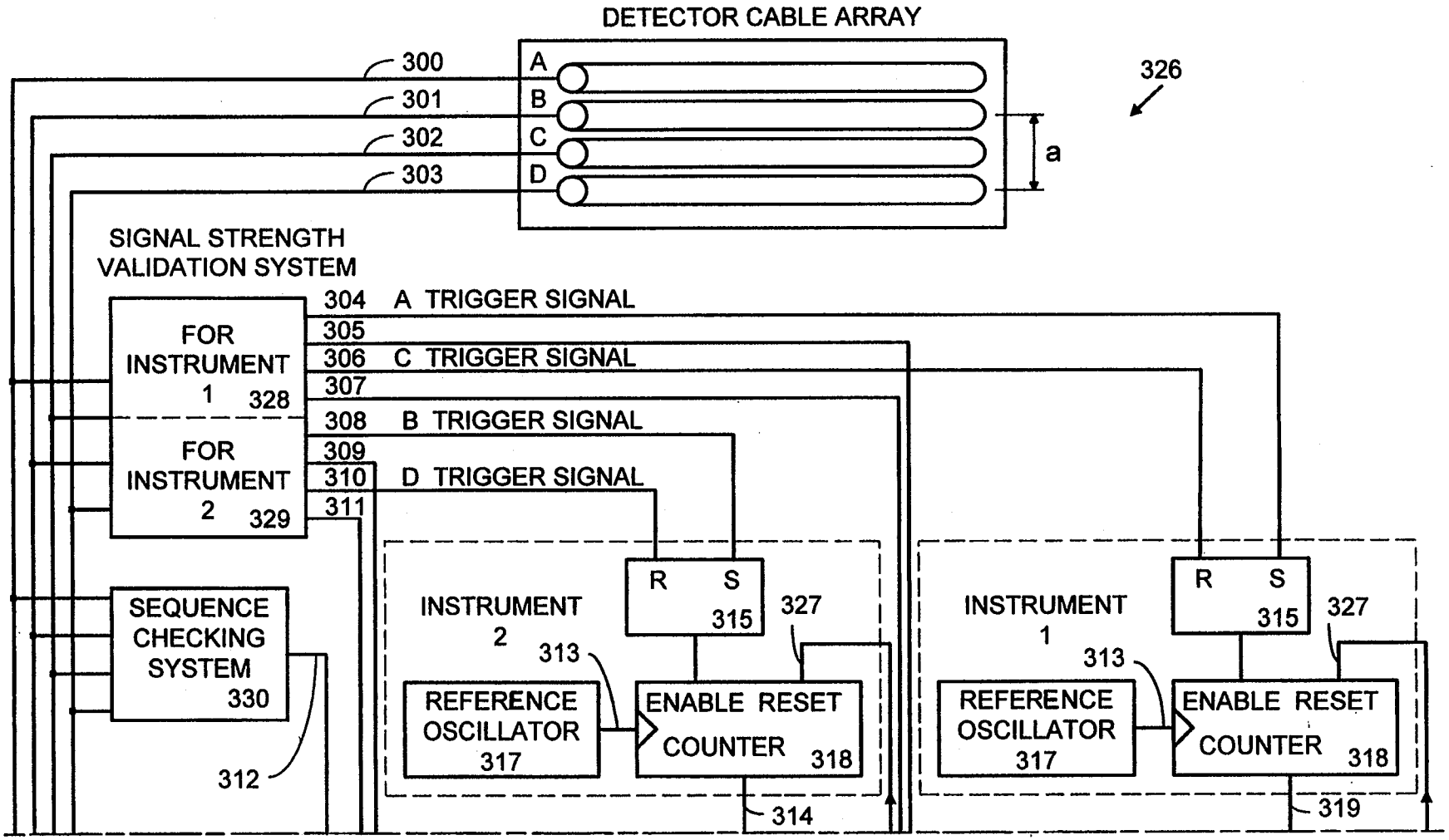
FIG. 10 is a diagram of traffic monitoring equipment in which apparatus for validation checks is incorporated.
Figure 10B:
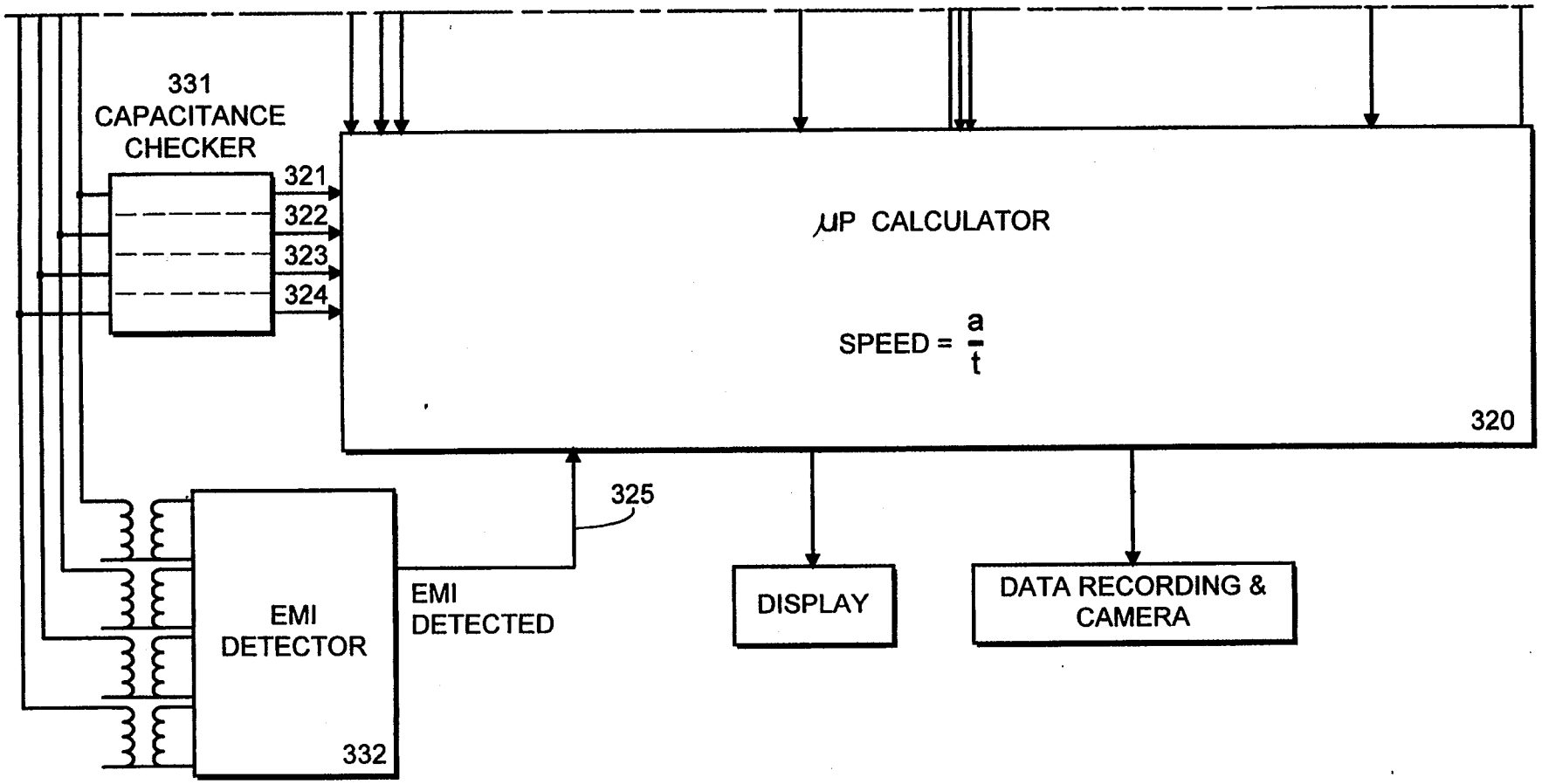

FIG. 10 is a block diagram of the system including the original speed calculating system and the additional elements, signal strength validation means 328 and 329, sequence checking means 330, capacitance checking means 331 and EMI detection means 332, all as described previously.

300 Signal from Detector Cable A
301 Signal from Detector Cable B
302 Signal from Detector Cable C
303 Signal from Detector Cable D other detectors, as indicated herein above could be moved or substituted
326 Distance "a" over which time is measured for speed calculation
304 A Trigger Signal to start instrument 1 timing
306 C Trigger Signal to stop instrument 1 timing
308 B Trigger Signal to start instrument 2 timing
310 D Trigger Signal to stop instrument 2 timing.
305 A Trigger's validation error signal
307 C Trigger's validation error signal
309 B Trigger's validation error signal
311 D Trigger's validation error signal
315 R/S gating latch
316 R/S gating latch
317 Reference Oscillator Clock
318 Binary Counter which counts only when "Enable" is true and may be reset.
327 Reset signal from microprocessor to reset counters once value has been processed.
319 Binary representation of the time elapsed from the A trigger signal to the C trigger signal.
314 Binary representation of the time elapsed from the B trigger signal to the D trigger signal.
320 Microprocessor or hardware calculating means which calculates the speed and then displays and records the information only if no error signals are present or were present during the calculation.
312 Sequence error signal.
321 322, 323, 324 are each capacitance error signals which become active if the capacitance of the cable is outside the limits set.
325 EMI detected signal (Error signal to the microprocessor)

We claim:

1. In traffic monitoring equipment, apparatus for validation checks in the equipment for checking correctness of a sequence of impulses derived from the passage of vehicles over sensors where the sensors are selected from the group consisting of cables, sensor pads magnetic loop detectors, optical sensors, and pneumatic tube sensors, which apparatus comprises means for comparing a sequence of impulses with a predetermined sequence for the impulses, means coupled to said means for comparing for rejecting the sequence of impulses if it does not agree with the predetermined sequence for the impulses and means coupled to said means for rejecting for generating an error signal if impulses generated by said sensors due to passage of vehicles over said sensors are rejected on one of a regular and repeated basis.

2. In traffic monitoring equipment, apparatus as claimed in claim 1, which comprises reset/set latches connected to each sensor, the latches being connected to a logic circuit which will accept a predetermined impulse sequences only.

3. In traffic monitoring equipment, apparatus for validation checks in the equipment, for monitoring signal strength of an impulse derived from the passage of a vehicle over a sensor, said sensor being selected from the group consisting of cables, sensor pads, magnetic loop detectors, optical sensors and, pneumatic tube sensors, which apparatus comprises detectors for detecting and measuring an impulse derived from the passage of a vehicle over said sensor, means for providing A reference signal and a comparator connected to the detector and to said means for providing a reference signal for determining an attainment by the impulse of a first value which is offset from a reference level provided by said means for providing a reference signal before the impulse is passed by a further connection to impulse processing equipment for traffic monitoring purposes.

4. In traffic monitoring equipment, apparatus as claimed in claim 3, in which further validation means is connected for receiving the impulse once it has attained said value and to detect whether the impulse continues to rise in a same direction to reach a higher value within a predetermined critical time period and further connected with a signal strength validation signal generating means for passing said impulse by a further connection to impulse processing equipment for traffic monitoring purposes if said impulse remains greater than said first value and less than said higher value during said predetermined critical time period.

5. In traffic monitoring equipment, generating an impulse, derived from passage of vehicles over sensors, said monitoring equipment being operated in the presence of a naturally occurring EMI level, apparatus for validation checks in the equipment which comprises structure for performing an electro-magnetic interference (EMI) check, which structure is connected to structure selected from the group consisting of a conventional antenna and a transformer coupling to external cables, the EMI checking structure comprising a barring means for disallowing use of said impulse from a traffic monitoring sensor by the monitoring equipment for traffic monitoring purposes if an EMI level exceeds a predetermined amplitude.

6. In traffic monitoring equipment, apparatus as claimed in claim 5, which comprises a filter connected between one of said group consisting of a conventional antenna and a transformed coupling to external cables and said barring means for determining a cut off frequency in a frequency band and for passing a signal which is above the cut off frequency to a wide band preamplifier with a low noise which is connected to the apparatus for amplifying the signal which is above the cut off frequency, a high speed diode connected to the preamplifier for rectifying the amplified signal to charge a capacitor connected with the diode and a comparator having predetermined threshold voltage and being connected with the capacitor for disallowing the impulse for traffic monitoring purposes if the voltage generated by the charge on said capacitor exceeds said predetermined threshold voltage.

7. In traffic monitoring equipment including sensors coupled to the equipment by cables having a capacitance and extending across a road or other surface for passage of vehicles, apparatus for validation checks of the equipment, said validation apparatus comprising capacitance monitoring means for monitoring said capacitance of the cables said monitoring means having detection means selected from the group consisting of means for detection of frequency changes, means for detection of phase changes, and means for detection of changes in natural frequency and ringing of the cable, said detection means determining changes in cable capacitance by utilizing said cable as a capacitive element in a reactive measurement circuit.

8. In traffic monitoring equipment, apparatus for validation checks in the equipment as claimed in claim 7, where in said reactive measurement circuit comprises a reactive Wheatstone bridge, said cable being connected to said bridge for balancing cable capacitance against a capacitor so that if said cable capacitance should change the resulting imbalance will be detected by a subtractor circuit which generates an error signal coupled to a comparator, said comparator being responsive to a predetermined threshold voltage for determining whether an amplitude of said error signal generated by said subtractor circuit exceeds said threshold, in which case a pulse changes the state of a latch to stop or reset a traffic data calculating means which is comprised within the traffic monitoring equipment.

9. Traffic monitoring equipment which comprises traffic detectors wherein said detectors are selected from the group of detectors consisting of cables, detector pads, magnetic loop detectors, optical systems and pneumatic tube systems;

at least one validation apparatus connected to the equipment wherein said validation apparatus is selected from the group consisting of signal strength validation means, sequence checking means, capacitance checking means, electromagnetic interference checking means for validating an output of said detectors as presenting valid data for use in traffic monitoring measurements; which equipment further comprises computing means coupled to an output of said validation apparatus for performing traffic monitoring measurements and output means coupled to an output of said computing means and selected from the group consisting of display means, data recording means and a camera recording means for presenting the measurements to a user;

means for submitting impulses from the detectors resulting from passage of vehicles to said validation apparatus and for coupling impulses validated as presenting valid data for traffic monitoring measurements to said computing means and for sending a computed result to said output means.

* * * * *